United States Patent [19]

Klawitter

[11] 4,332,394

[45] Jun. 1, 1982

[54] ROLLER SKATE

[75] Inventor: Ronald R. Klawitter, Hermann, Mo.

[73] Assignee: Steven Manufacturing Company, Hermann, Mo.

[21] Appl. No.: 159,776

[22] Filed: Jun. 16, 1980

[51] Int. Cl.[3] ..... A63C 17/02

[52] U.S. Cl. ..... 280/11.27; 280/11.19

[58] Field of Search ..... 280/11.19, 11.27, 11.22, 280/11.28, 11.23, 11.1 R

[56] References Cited

U.S. PATENT DOCUMENTS 4,058,323 11/1977 Ware, Jr. ..... 280/11.28
4,146,241 3/1979 Stevenson ..... 280/11.28

FOREIGN PATENT DOCUMENTS 2820681 11/1978 Fed. Rep. of Germany ..... 280/11.3
178831 8/1935 Switzerland ..... 280/11.3

*Primary Examiner*—Joseph F. Peters, Jr.
*Assistant Examiner*—Ross Weaver
*Attorney, Agent, or Firm*—Polster, Polster and Lucchesi

[57] ABSTRACT

In a steerable roller skate a one-piece sole plate has a bottom wall, with a pair of support shaft bosses in the bottom wall, each with an open-ended vertical passage. An elongated steel shape having internally threaded bolt-receiving spuds spaced along its length complementarily to the bosses is positioned to be coaxial with the boss openings. Shaft bolts, for mounting wheel trucks, extend through the boss passages and into threaded engagement with the spuds. The underside of the sole plate has a pair of bearing tongue seats formed in it. Neither the shaft bosses nor the seats have a reentrant surface with respect to the adjacent surfaces of the underside of the sole plate.

3 Claims, 16 Drawing Figures

ROLLER SKATE

BACKGROUND OF THE INVENTION

In sole plates known heretofore that involve the use of wheel trucks mounted on a shaft and supported for tilting movement by a strut or tongue projecting into a socket made integral with the sole plate, the shaft has been threaded into a boss, and both the boss and the socket have been formed at an angle to the sole plate. This is illustrated in U.S. Pat. No. 4,058,323, and in a somewhat different form, in U.S. Pat. No. 4,159,830.

One of the objects of this invention is to provide a sole plate adapted to use with a wheel truck mounted on a shaft and supported for tilting movement by a tongue projecting into a socket made integral with the sole plate, that can be produced in a simple two-piece mold.

Another object is to provide such a sole plate that can be made economically of plastic but which is strong.

Other objects will become apparent to those skilled in the art in the light of the following description and accompanying drawing.

SUMMARY OF THE INVENTION

In a steerable roller skate a one-piece sole plate has a bottom wall, with a pair of support shaft bosses in the bottom wall, each with an open-ended vertical passage. An elongated steel shape having internally threaded bolt-receiving spuds spaced along its length complementarily to the bosses is positioned to be coaxial with the boss openings. Shaft bolts, for mounting wheel trucks, extend through the boss passage and into threaded engagement with the spuds. The underside of the sole plate has a pair of bearing tongue seats formed in it. Neither the shaft bosses nor the seats have a reentrant surface with respect to the adjacent surfaces of the underside of the sole plate.

DESCRIPTION OF THE PREFERRED EMBODIMENT

Figure 1:
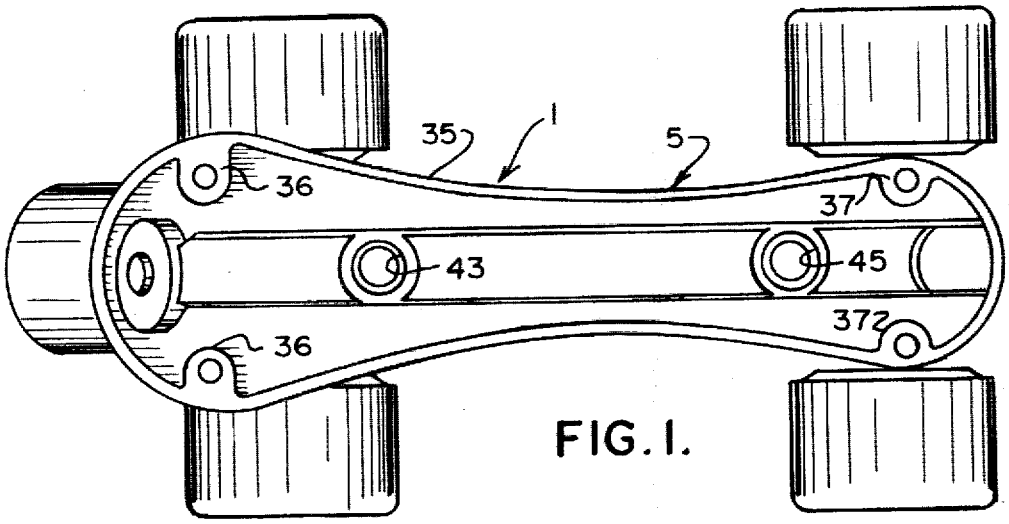
FIG. 1 is a top plan view of a roller skate illustrating one embodiment of this invention, without a shoe and without a reinforcing shape.

Referring now to the drawing for an illustrative embodiment of this invention, reference numeral 1 indicates a steerable roller skate which in this embodiment is of the type to which a shoe 2 is attached. The skate 1 includes an elongated sole plate 5 in the form of an open-topped dish with a bottom wall 7, a continuous side wall 15, and a shoe engaging rim 35.

Figure 4:
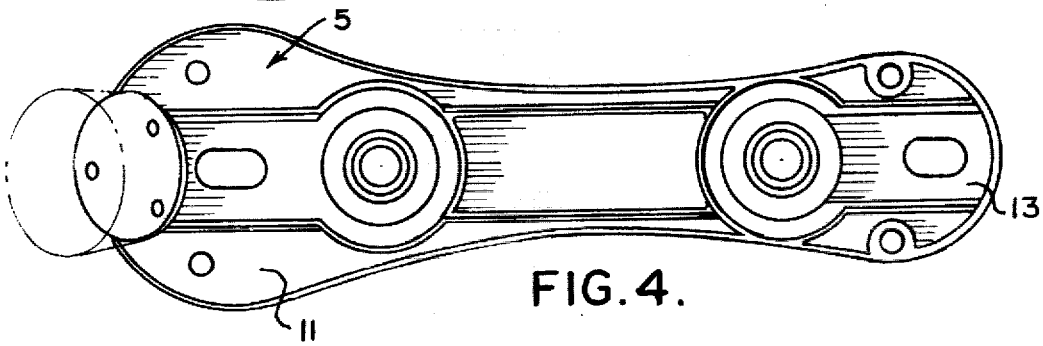
FIG. 4 is a bottom plan view of the sole plate alone, with a stop shown in phantom lines.
Figure 10:
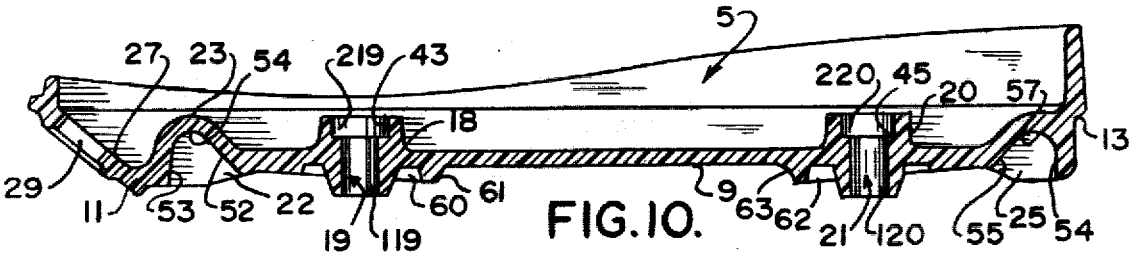
FIG. 10 is a sectional view taken along the line 10—10 of FIG. 9.
Figure 11:
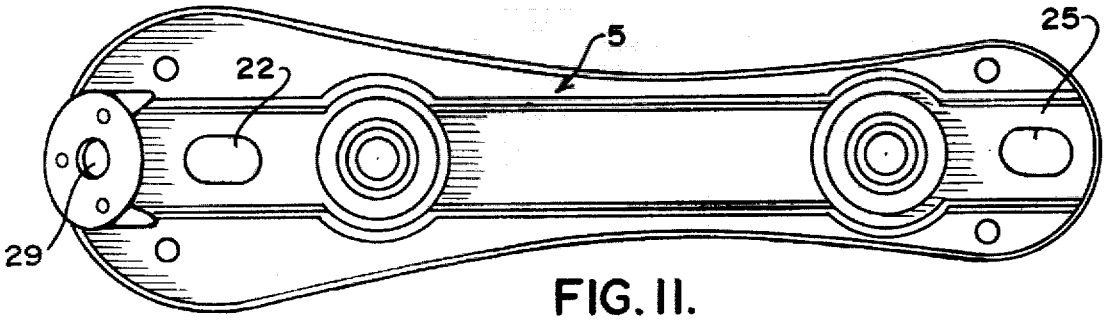
FIG. 11 is a top plan view.
Figure 12:
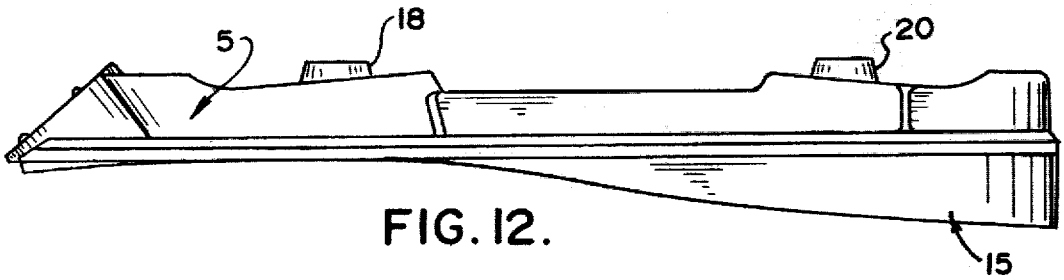
FIG. 12 is a view in side elevation of the sole plate.
Figure 13:
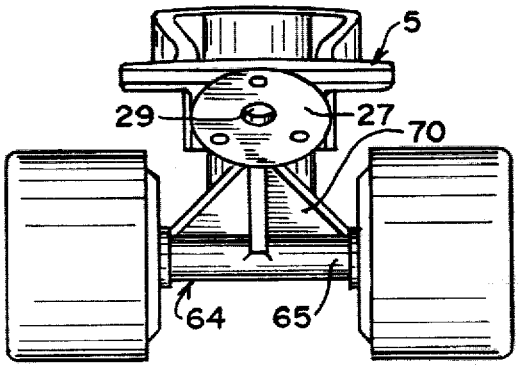
FIG. 13 is a view in front elevation of the skate without front stop or shoe.
Figure 14:
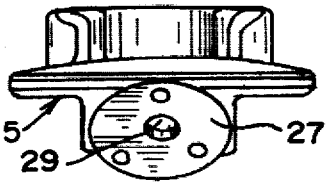
FIG. 14 is a view in front elevation of the sole plate alone.
Figure 15:
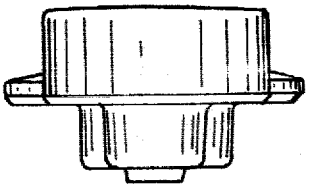
FIG. 15 is a view in rear elevation of the sole plate alone.

The bottom wall 7 includes a central section 9, a toe section 11 and a heel section 13 (see FIGS. 4 and 10).

The side wall 15 includes a toe part 16 and an upwardly rearwardly rising part 17.

As shown particularly in FIG. 10, between the central section 9 and the toe section 11 of the bottom wall, and integral with the bottom wall, is a toe end support shaft boss 18 with a vertical, cylindrical bore 19. Between the central section 9 and the heel section 13, and integral with the bottom wall, is a heel end support shaft boss 20 with a vertical, cylindrical bore 21. Both bosses 18 and 20 project beyond the upper and lower surfaces of the bottom wall 7. In this embodiment, the upper ends of the bosses are generally cylindrical. The depending, lower ends of the bosses are in the form of truncated, inverted cones.

Also integral with the bottom wall, in the toe section 11, is a front bearing tongue seat 22, and in the heel section 13, a rear bearing tongue seat 25. The front bearing tongue seat 22 forms a hump 23 in the upper surface of the bottom wall 7.

Forwardly of the front bearing tongue seat 22, at the forward end of the toe section of the bottom wall, is an upwardly forwardly sloping web 27, extending between the bottom wall and the frontmost part of the side wall 15. A stop bolt aperature 29 extends through the sloping web 27. In this embodiment, the bolt aperature has its axis perpendicular to the plane of the surface of the web. As will be explained, the bolt aperature 29 can be defined by edges that are vertical. A stop bolt 30 extends through the aperature 29 (see FIG. 2). The stop bolt 30 has a head 32 at one end and a threaded section on its other.

Front rivet bosses 36 and rear rivet bosses 37 are, in this embodiment, integral with and inboard of the rim 35.

The bore 19 of toe end shaft boss 18 has a restricted lower passage part 119 and an upper, enlarged passage part 219. The upper passage part 219 forms a seat 43. The heel end shaft boss 20 has a restricted lower passage part 120 and an upper, enlarged passage part 220. The upper passage part 220 forms a seat 45.

The toe end tongue seat is defined by an upwardly forwardly sloping wall part 52, a generally vertical wall part 53, and a domed bearing area 54. The heel end tongue seat is defined by an upwardly rearwardly sloping wall part 55, a generally vertical wall part 56 and a domed bearing area 57.

On the undersurface of the bottom wall 7 around the conical toe end boss is a seat 60 defined by a lip 61. A seat 62 around the conical heel end boss 20 is defined by a lip 63.

Except for the hump 23 and the bosses 18 and 20, the upper surface of the bottom wall 7 is substantially flat and the wall itself is of generally uniform thickness.

Figure 5:
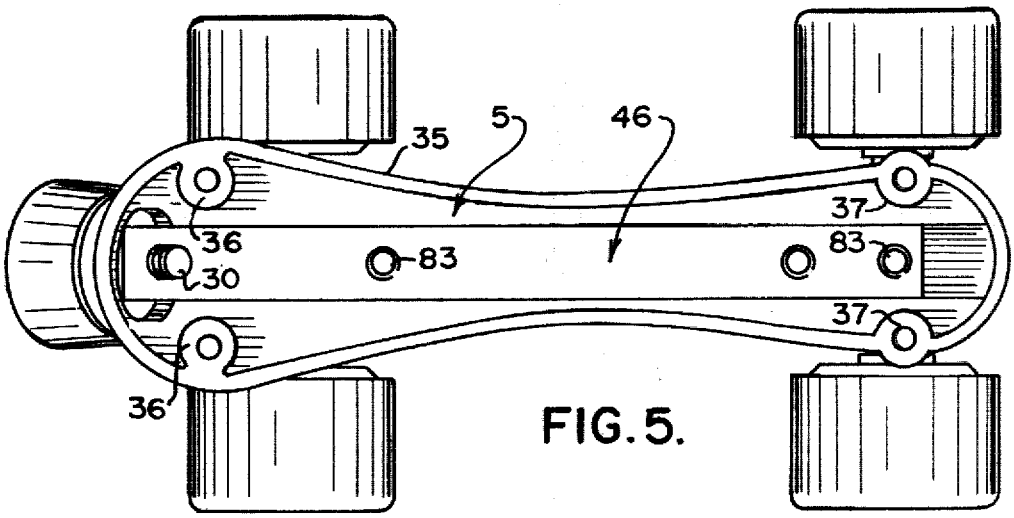
FIG. 5 is a top plan view of the skate without the shoe.
Figure 6:
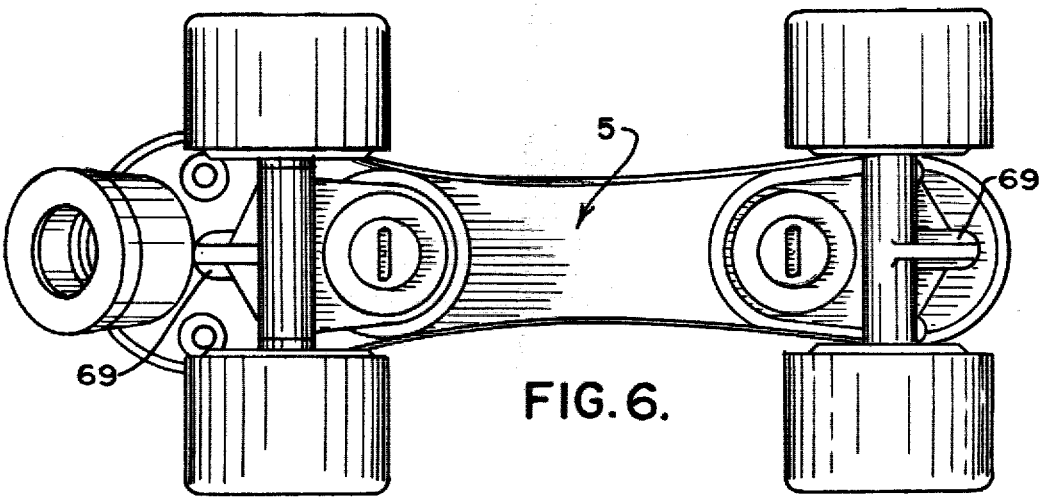
FIG. 6 is a bottom plan view of the skate.
Figure 7:
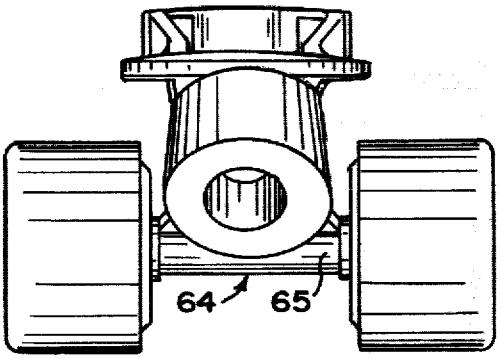
FIG. 7 is a view in front elevation of the skate without the shoe.
Figure 8:
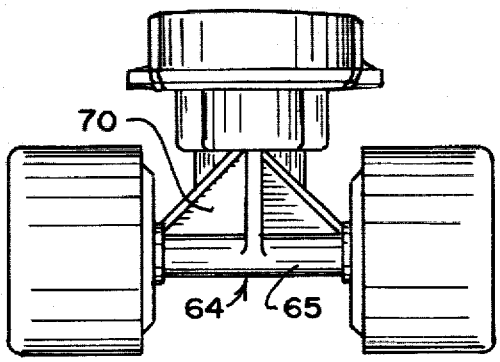
FIG. 8 is a view in rear elevation.
Figure 16:
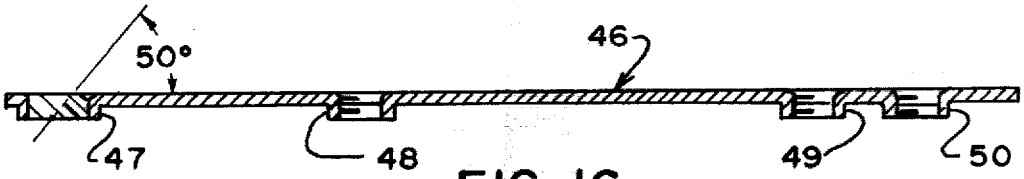
FIG. 16 is a longitudinal sectional view of one embodiment of reinforcing shape.
Figure 9:
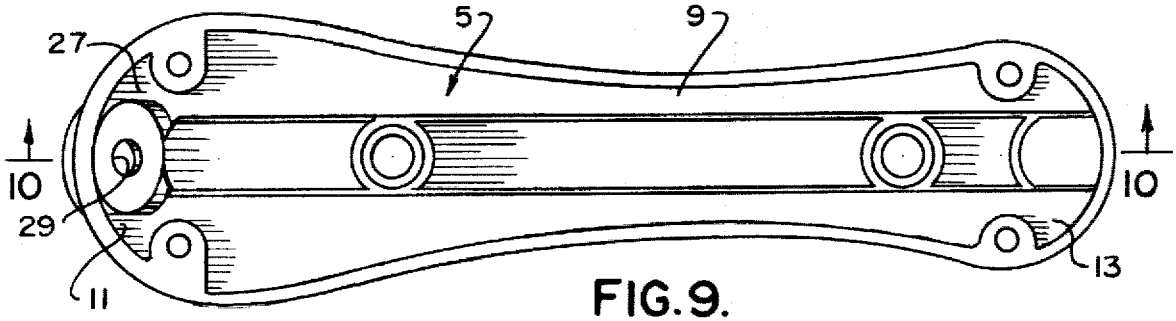
FIG. 9 is a bottom plan view of the sole plate alone.

The sole plate of this invention is given rigidity and strength in its long direction by the provision of a steel shape 46 (see FIGS. 5 and 16). In the embodiment shown, the shape 46 is in the form of an elongated, heavy gauge strap. The shape 46 is shown as having four, internally threaded spuds, a stop spud 47, a forward spud 48, a short shoe rear spud 49, and a medium shoe rear spud 50. In the embodiment shown, the spuds are formed integrally with the strap by piercing and drawing the strap to form a depending sleeve or boss, which is then internally threaded. The stop spud 47, in the toe end of the shape, is somewhat elongated in plan view, and its threads are oriented perpendicular to the slope of the web 27. The forward spud 48 has threads in a vertical surface, as do the rear spuds 49 and 50

The spud 47 is positioned coincidentally with the opening 29 so as to receive the bolt 30. The spud 48 is coaxial with the bore 19, and extends into and is seated in the seat 43 of the boss 18. The spud 49 is positioned coaxially with the bore 21 and is seated in the seat 45 of the boss 20. When the sole plate and wheel trucks are assembled as is described hereinafter, the shape forms with the bottom wall 7, between the forward part of the toe end and the rearmost edge of the boss 20, a sort of box beam which provides strength and rigidity in the long dimension of the sole plate. The provision of more than one rear spud permits the use of the same shape for more than one size sole plate.

Toe and heel end trucks 64 can be identical. Each has an axle journal 65 with an axle receiving bore 67, a tongue 69, reinforcing gussets 70, an offsetting bracket 72 and a mounting platform 75. In the embodiment of truck shown, the mounting platform 75 has an integral sleeve defining an opening of large diameter as compared with the passages 19 and 21, with an upper rim 77 and a lower rim 78. In this embodiment, each of the mounting platforms 75 is sandwiched between an upper rubber mounting sleeve 79 and a lower rubber mounting sleeve 80. The upper sleeve 79 is molded with a seat 81 in its lower surface and the lower sleeve 80, with a seat 82 in its upper surface to receive the upper and lower rims 77 and 78 respectively. The upper sleeve also has a seat 97 formed complementarily to the truncated conical lower end of the bosses 18 and 20, the upper end of the sleeves 79 seating in the seats 60 and 62, respectively.

Both trucks are mounted on support shaft bolts 83. In the embodiment shown, each bolt 83 has a slotted head 84 at its lower end, a smooth shaft 85 extending through the opening in the mounting platform sleeve and the passages in the lower ends of the bosses 18 and 20, and a threaded upper end portion 86 extending through the upper passage of the bosses and threaded into the spud of the shape seated in the seat of the particular boss.

An axle 100 journaled in bore 67 and wheels 101 are conventional.

Figure 2:
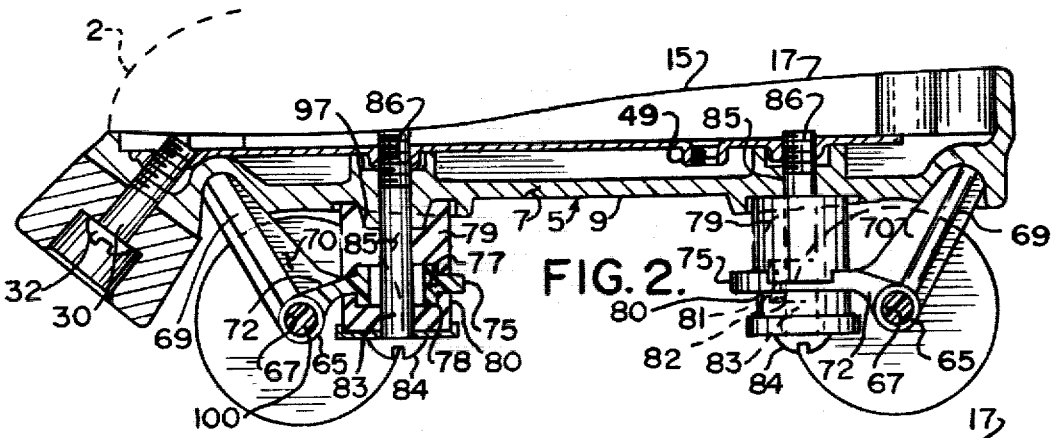
FIG. 2 is a sectional view taken along the line 2—2 of FIG. 1, with a shoe upper indicated fragmentarily.
Figure 3:
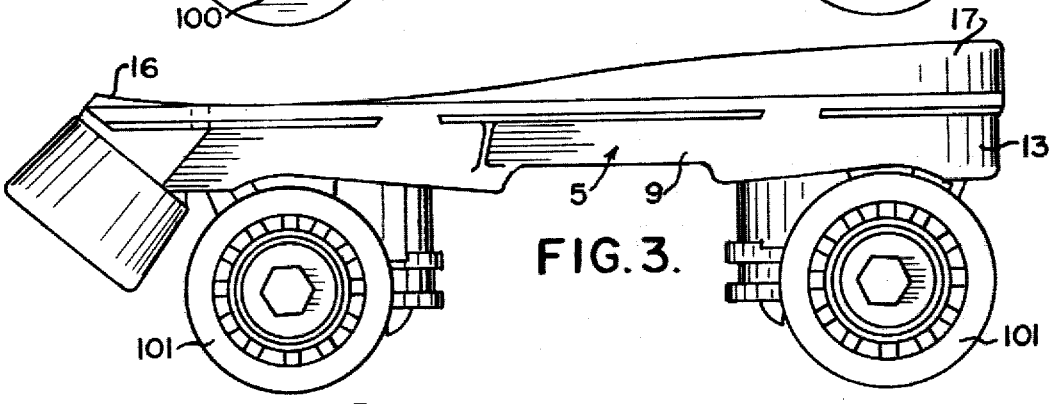
FIG. 3 is a view in side elevation.

The tongue 69 of the front wheel truck is mounted in front bearing tongue seat 22, and the tongue 69 of the rear wheel truck is mounted in the rear bearing tongue seat, as shown in FIG. 2, for limited skewing of the axles with respect to the longitudinal axis of the skate as is well known in the steerable roller skate art.

As will be readily apparent from the drawings, there are no reentrant angles in the bottom wall, support shaft bosses 18 and 20, or bearing seats 22 and 25. There are no internal threads in any of the sole plate parts. Accordingly, the sole plate can be molded in a simple two-piece mold with a straight draw. The stop bolt aperature 29 is designed to be made with split straight core pins, the upper half of the opening being formed by a semicircular pin in the lower half of the mold, and the lower half of the aperature being formed by a semicircular pin in the upper half of the mold. However, because the stop or bumper 33 is carried by the spud 47, hence by the shape 46, the aperature 29 can be made with edges that are substantially vertical, rather than perpendicular to the adjacent, sloping surface of the sole plate, to obviate the need for split pins.

Numerous variations in the construction of the skate of this invention within the scope of the appended claims will occur to those skilled in the art in the light of the foregoing disclosure. The sole plate can be made of either plastic or metal, but in any event, can easily be made in one piece in a simple molding operation. The rim on the sole plate can define a plane surface, rather than a rising, contoured, one. A channel running lengthwise of the sole plate can be provided to accomodate the shape, leaving the adjacent surface of the top of the sole plate flat. The shape can be made in any desired form, such as a channel, or provided with a longitudinal center rib. The spuds can be provided by welding nuts to the shape or by merely tapping holes in the shape itself, without drawing a sleeve or boss member of the sort shown in the preferred embodiment, although it is preferable to have either an integral cup-shaped spud or a welded nut, to seat in the upper end of the bosses, both for strength and for the purpose of locating the shape. The shape can be bent up at its forward end, to permit the spud to be threaded on surfaces perpendicular to the plane of the shape. Various reinforcing ribbings can be provided in the sole plate, and the exact configuration of the sole plate can be varied widely, as can the construction of the trucks. These are merely illustrative.

Having thus described the invention what is claimed and desired to be secured by Letters Patent is:

1. In a steerable roller skate sole plate and wheel truck assembly, the improvement comprising a one-piece elongated sole plate having a shoe-engaging part and a pair of support shaft bosses spaced along the long direction of said sole plate, each lying below the level of said shoe-engaging part and defining an open-ended substantially vertical support-shaft bolt-receiving passage, an elongated steel shape having internally threaded bolt-receiving spuds spaced along its length complementarily to said bosses and positioned to be coaxial with said boss openings and shaft bolts, for mounting wheel trucks, said bolts being threaded at their upper ends and extending through said boss passages and into threaded engagement with said spuds, said shape lying entirely below the level of said shoe-engaging part.

2. The improvement of claim 1 wherein the said bosses each define a lower passage closely to receive said shaft bolt and an upper passage of larger diameter to form an open seat, and said steel shape spuds depend from said shape and into said open seats.

3. The improvement of claim 1 wherein the sole plate has a bumper bolt hole in its toe end and said steel shape has an internally threaded bumper bolt-receiving spud at its forward end threadedly to receive a bumper bolt.

* * * * *